US007466788B2

(12) United States Patent
Hoover et al.

(10) Patent No.: US 7,466,788 B2
(45) Date of Patent: Dec. 16, 2008

(54) ELECTRONIC APPLICATOR COUNTER

(75) Inventors: George Edward Hoover, Dover, PA (US); Keith Lynn Nicholas, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/091,097

(22) Filed: Mar. 28, 2005

(65) Prior Publication Data

US 2006/0222141 A1 Oct. 5, 2006

(51) Int. Cl.
*G07C 3/00* (2006.01)
*G07C 3/02* (2006.01)

(52) U.S. Cl. ..... 377/15; 377/16

(58) Field of Classification Search ..... None
See application file for complete search history.

(56) References Cited

U.S. PATENT DOCUMENTS

| | | | | |
|---|---|---|---|---|
| 4,140,897 | A | 2/1979 | Guerra | |
| 4,265,370 | A * | 5/1981 | Reilly | 222/25 |
| 4,539,641 | A * | 9/1985 | Kawashimo et al. | 701/35 |
| 4,726,044 | A * | 2/1988 | Perna et al. | 377/15 |
| 4,768,209 | A * | 8/1988 | Yu | 377/6 |
| 5,117,444 | A * | 5/1992 | Sutton et al. | 377/24.2 |
| 5,603,127 | A * | 2/1997 | Veal | 4/246.1 |
| 5,625,659 | A * | 4/1997 | Sears | 377/21 |
| 5,864,781 | A * | 1/1999 | White | 702/182 |
| 6,707,873 | B2 * | 3/2004 | Thompson et al. | 377/13 |
| 2003/0132612 | A1 * | 7/2003 | Pike et al. | 280/642 |

FOREIGN PATENT DOCUMENTS

| | | |
|---|---|---|
| DE | 44 42 193 | 5/1996 |
| DE | 197 36 057 | 2/1999 |
| DE | 100 23 425 | 11/2001 |
| DE | 100 45 207 | 3/2002 |

OTHER PUBLICATIONS

Applitek Technologies Corporation, PSC-06E Shot Counter, 8 pages, http://www.applitek-usa.com/brochure7.html.
Tyco Electronics, Applicators for Non-AMP Terminals and Contacts, 4 pages, www.amp.com/tooling, Catalog 296393, Revised 9-99.

* cited by examiner

*Primary Examiner*—Tuan T Lam

(57) ABSTRACT

The present disclosure relates to applicator counters and assemblies for counting, recording and transmitting cycles of machines, tools and the like. An applicator counter assembly for operative association with an applicator or the like is provided. The applicator counter assembly includes an applicator counter for counting, recording and transmitting cycles of the applicator. The applicator counter includes a magnetically responsive switch capable of being actuated in response to a magnetic force, whereby the applicator counter registers a count for each actuation of the switch.

21 Claims, 6 Drawing Sheets

ELECTRONIC APPLICATOR COUNTER

BACKGROUND

1. Technical Field

The present disclosure relates to electronic devices and, more particularly, to electronic applicator counters for counting, recording and transmitting cycles of machines, tools and the like.

2. Background of Related Art

Current devices and/or equipment operatively connected to applicators (e.g., machines and the like), used to count cycles and the like, are typically simple mechanical counters or electromechanical counters. Information and records regarding the maintenance of the applicator are kept at a location and/or in a device which is separate from the applicator counter itself. In other words, various numbers of cables and/or wires may extend from the applicator counter to a separate storing and/or recording device, where the cycles counted are kept and stored. Alternatively, an individual must inspect the applicator counter, at regular intervals, and manually record the information collected (e.g., cycles) and either enter that information into a separate device at that moment or enter that information into a separate device at a later time.

Repetitive use of machines and tools results in machine or tooling wear. Accordingly, if continuous and meticulous records are kept and analyzed for the usage of the machine and/or tool, a user may be better able to predict and/or forecast when machine and/or tool maintenance or replacement will be necessary. In this manner, all the necessary replacement machines and/or tools may be acquired ahead of time, or all of the necessary repair equipment may be readied ahead of time in order to reduce the time the machine and/or tool is kept idle, i.e., downtime.

The need exists for devices and/or equipment capable of counting cycles and other data associated with the operation of machines, tools and the like, as well as being capable of recording and/or storing the data for manipulation at the time the data is taken or at a later time.

The need also exists for devices and/or equipment capable of transmitting the data to a remote processing unit either instantly or at a later time.

SUMMARY

The present disclosure relates to electronic devices and applicator counters for counting, recording and transmitting cycles of machines, tools and the like.

According to one aspect of the present disclosure, an applicator counter for counting, recording and transmitting cycles of machines, tools and the like is provided. The applicator counter includes a housing defining at least one window; a display operatively disposed within the housing and visible through the window formed in the housing; and a circuit board assembly operatively disposed within the housing and in electrical contact with the display.

The circuit board assembly includes a printed circuit board; a microchip supported on the printed circuit board for processing and manipulating information; an energy source supported on the printed circuit board for powering at least the display and the microchip; a storage element supported on the printed circuit board for storing information; and a magnetically responsive switch supported on the printed circuit board. The switch is configured to actuate in response to a magnetic force, whereby the circuit board assembly registers a count for each actuation (e.g., closing) of the switch.

It is envisioned that the magnetically responsive switch is a reed switch. Desirably, the circuit board assembly includes at least a pair of reed switches positioned at opposing sides thereof.

The circuit board may further include a data transmitting controller supported on the printed circuit board for transmitting information to a remote location. The data transmitting controller is desirably an IrDA® controller.

In an embodiment, the display is a liquid crystal display.

According to another aspect of the present disclosure, an applicator counter assembly for operative association with an applicator or the like is provided. The applicator counter assembly includes an applicator counter for counting, recording and transmitting cycles of the applicator. The applicator counter includes a switch configured to actuate in response to a magnetic force, whereby the applicator counter registers a count for each actuation of the switch.

The applicator counter assembly further includes a counter mounting kit for mounting the applicator counter to the applicator. The counter mounting kit includes a bracket configured to interconnect the applicator counter and the applicator; and a magnet operatively supportable on a working element of the applicator. In one embodiment, the magnet has a first position, corresponding to when the working element is in an idle condition, in which the magnet does not cause the magnetically responsive switch to actuate. In the same embodiment, the magnet has a second position, corresponding to when the working element is in an active condition, in which the magnet causes the magnetically responsive switch to actuate. The circuit board assembly in turn registers each count.

The applicator counter desirably includes a housing defining at least one window; a display operatively disposed within the housing and visible through the window formed in the housing; and a circuit board assembly operatively disposed within the housing and in electrical contact with the display. The circuit board assembly includes a printed circuit board; a microchip supported on the printed circuit board for processing and manipulating information; an energy source supported on the printed circuit board for powering at least the display and the microchip; and a storage element supported on the printed circuit board for storing information.

In an embodiment, the magnetically responsive switch is a reed switch. Desirably, at least a pair of reed switches is provided with each reed switch being supported at opposite ends of the printed circuit board.

The circuit board desirably includes a data transmitting controller supported on the printed circuit board for transmitting information to a remote location. Desirably, the data transmitting controller is an IrDA® controller.

The display is desirably a liquid crystal display.

The counter mounting kit may further include a guide selectively mountable to the bracket; and a rod extending through the guide and configured to support the magnet thereon. The rod is selectively connectable to the working element of the machine, wherein movement of the working element results in movement of the rod. It is envisioned that the bracket is configured to enable adjustment of the location of the applicator counter. In an embodiment, the guide is a clevis and the rod extends through arms of the clevis.

In use, when the working element of the machine is in an active condition, the magnet is positioned at a magnetically effective distance relative to the magnetically responsive switch.

For a better understanding of the present invention and to show how it may be carried into effect, reference will now be made by way of example to the accompanying drawings.

DETAILED DESCRIPTION OF EMBODIMENTS

Figure 1:
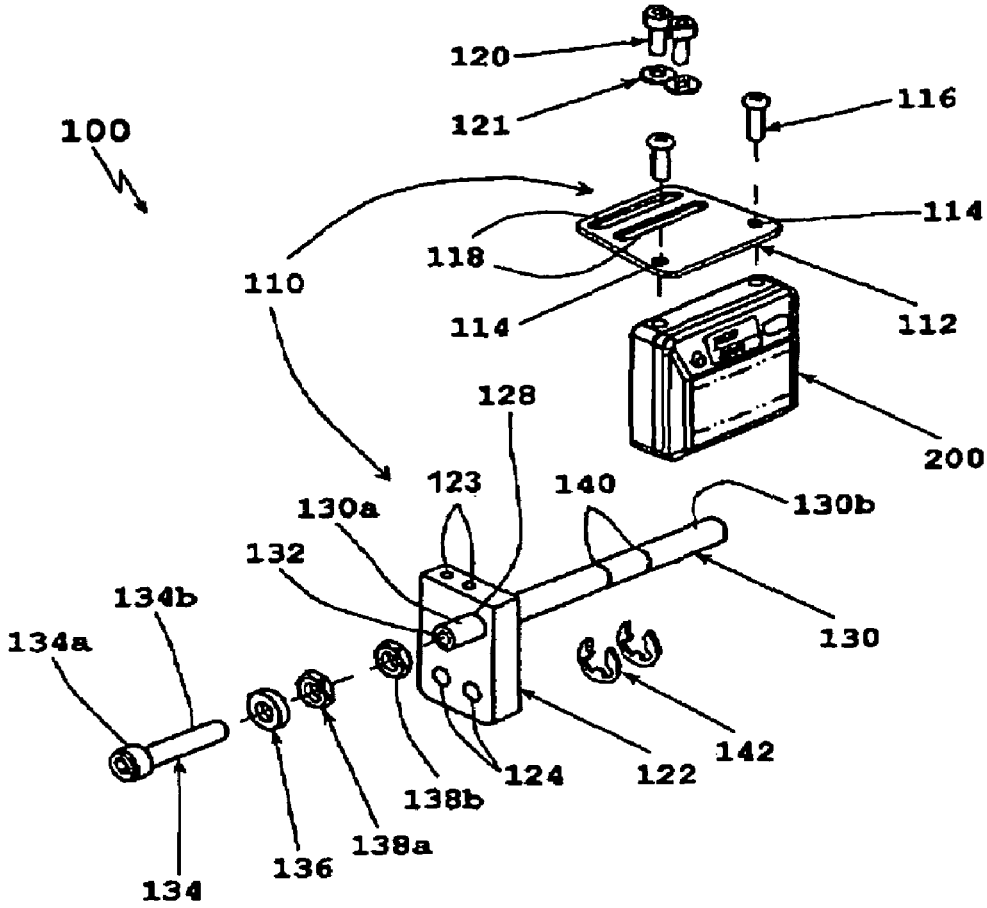
FIG. 1 is a perspective view, with parts separated, of an application counter assembly according to an embodiment of the present disclosure.

Embodiments of the presently disclosed applicator counter assembly will now be described in detail with reference to the drawing figures wherein like reference numerals identify similar or identical elements. As used herein and as traditional, the term "distal" refers to that portion which is furthest from the user while the term "proximal" refers to that portion which is closest to the user.

The applicator counter assembly of the present disclosure is a simple and inexpensive computer control device capable of storing information for terminal setup and capable of collecting data for a scheduled maintenance and calibration program.

Figure 2:
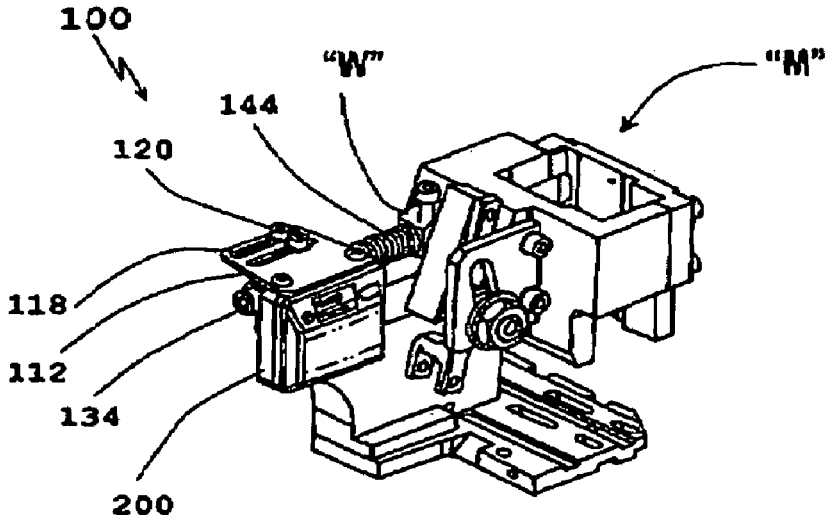
FIG. 2 is a perspective view of the application counter assembly of FIG. 1 shown operatively connected to a side feed applicator.
Figure 3:
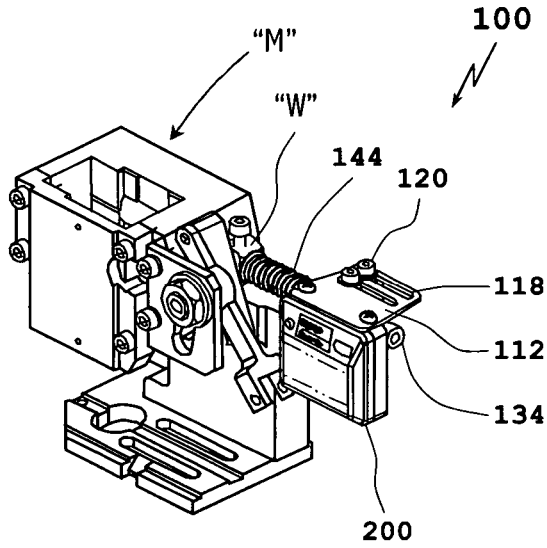
FIG. 3 is a perspective view of the application counter assembly of FIG. 1 shown operatively connected to an end feed applicator.
Figure 4:
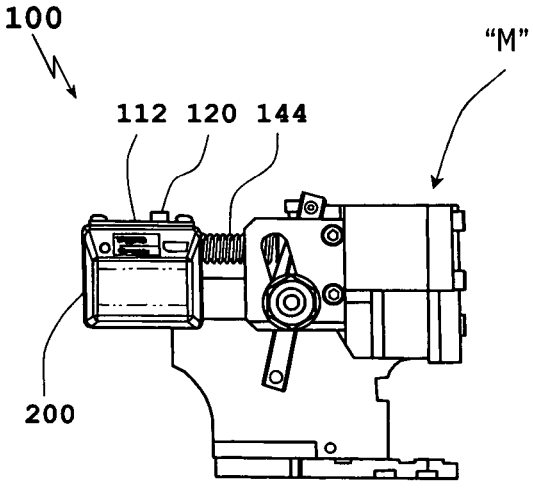
FIG. 4 is a front elevational view of the side feed applicator of FIG. 2 including the application counter assembly of FIG. 1.
Figure 5:
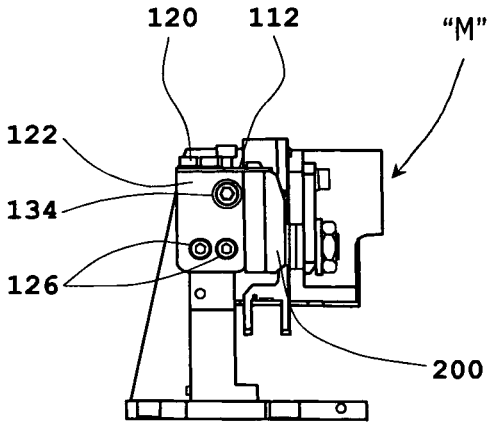
FIG. 5 is a side elevational view of the side feed applicator of FIGS. 2 and 4 including the application counter assembly of FIG. 1.
Figure 6:
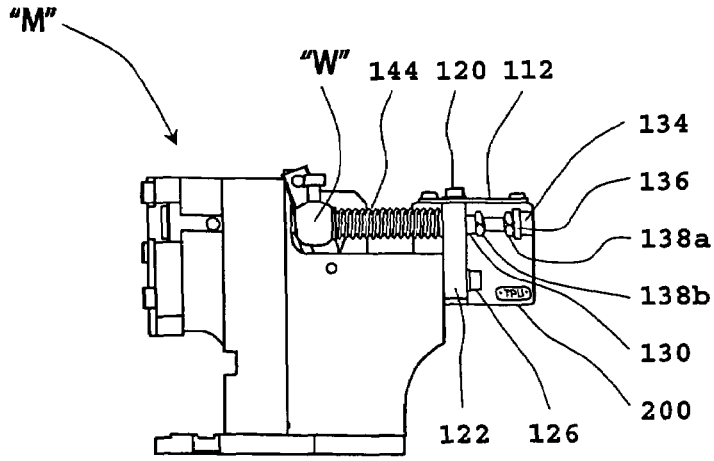
FIG. 6 is a rear elevational view of the side feed applicator of FIGS. 2, 4 and 5 including the applicator counter assembly of FIG. 1.
Figure 7:
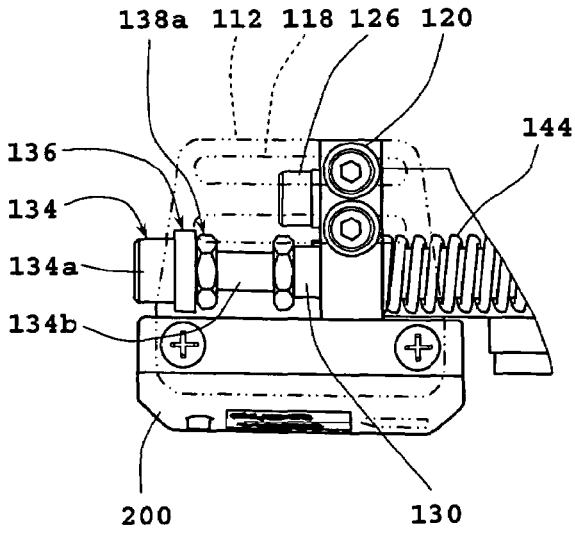
FIG. 7 is an enlarged top plan view illustrating the connection of the applicator counter assembly of FIG. 1 to the applicator.
Figure 8:
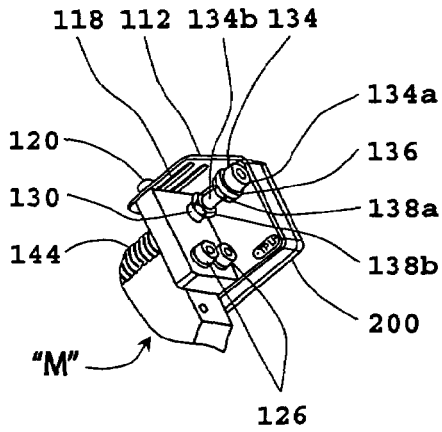
FIG. 8 is a bottom, perspective view illustrating the connection of the applicator counter assembly of FIG. 1 to the applicator.

Referring initially to FIGS. 1-8, an applicator counter assembly, in accordance with an embodiment of the present disclosure and for operative engagement with a machine and/or tool (e.g., an applicator or the like), is generally designated as 100. Applicator counter assembly 100 includes a counter 200, and a counter mounting kit 110 configured and adapted to selectively operatively connect counter 200 to a machine and/or tool "M". Desirably, counter mounting kit 110 and counter 200 are configured for side attachment to machine and/or tool "M", as seen in FIG. 2, and/or end attachment to machine and/or tool "M", as seen in FIG. 3.

As seen in FIG. 1, counter mounting kit 110 includes a counter mounting bracket 112 including at least one hole 114 formed therein for receiving a corresponding securing element 116 (e.g., a screw or the like) therethrough. Desirably, a pair of holes 114 is provided for receiving a pair of screws 116 for securing counter 200 thereto. Bracket 112 further includes at least one elongate slot 118 formed therein and extending at least substantially across the entire rear portion of bracket 112. Desirably, a pair of substantially parallel elongate slots 118 is formed in bracket 112. While a pair of parallel elongate slots 118 are shown and described, it is envisioned that any configuration of apertures may be provided. Slots 118 enable the adjustment of and desired placement of counter 200 relative to machine "M". Each slot 118 is configured and dimensioned to receive a respective mounting element 120 (e.g., a screw) or the like.

Counter mounting kit 110 further includes a guide 122 selectively mountable to bracket 112. Guide 122 includes at least one aperture formed in an upper surface thereof for receiving corresponding screws 120 extending through nuts 121 and elongate slots 118. Guide 122 further includes at least one mounting hole 124 formed therethrough for receiving a mounting screw 126 (see FIGS. 5-8). Desirably, a pair of mounting holes 124 is provided. Mounting holes 124 and mounting screws 126 are used to secure guide 122 to machine and/or tool "M". Desirably, screws 120 extend through slots 118 and engage complementary holes 123 formed in a top surface of guide 122.

Counter mounting kit 110 further includes an adjustment rod 130 slidably extending through an appropriately sized aperture 128 formed in guide 122. Desirably, adjustment rod 130 extends orthogonally through guide 122. Adjustment rod 130 includes a first end **130*a* and a second end 130*b*. First end 130*a* of adjustment rod 130 extends through aperture 128 formed in guide 122, and second end 130*b* of adjustment rod 130 is configured for operative engagement to a working element "W" of machine "M" (see FIG. 6**).

Adjustment rod 130 includes a threaded opening 132 formed in first end **130*a* thereof for receiving an adjustment screw 134. A magnet 136 (i.e., a ring magnet) is positioned on shaft portion 134*b* of adjustment screw 134, against head portion 134*a* of adjustment screw 134. A first locking element 138*a* (i.e., a nut) may be used to secure ring magnet 136 against head portion 134*a* of adjustment screw 134. A second locking element 138*b* (i.e., a nut) may be used fix the location of ring magnet 136 relative to adjustment rod 130. More particularly, as will be described in greater detail below, second locking element 138*b* functions to fix the location of ring magnet 136 to counter 200 when working element "W" of machine "M" is in an idle condition. Desirably, when working element "W" of machine "M" is in the idle condition, ring magnet 136 is disposed proximate a predetermined location of counter 200 (see FIGS. 6-8**).

As seen in FIG. 1, a pair of spaced apart annular grooves 140 is formed in adjustment rod 130, between first end **130*a* and second end 130*b*. Annular grooves 140 are each configured and dimensioned to operatively receive a respective retaining ring 142. Desirably, second end 130*b* of adjustment screw 130 extends through working element "W" of machine "M" and retaining rings 142 are disposed on either side of working element "W". In this manner, adjustment rod 130 will axially translate in the direction of movement of working element "W". Desirably, a compression spring 144 is positioned about adjustment rod 130 and between guide 122 and a retaining ring 142. In this manner, compression spring 144 will bias adjustment rod 130, and in turn ring magnet 136 into magnetic engagement with counter 200** when working element "W" returns to the idle condition.

In use, as will be described in greater detail below, when working element "W" of machine "M" is in an idle or first condition (see FIGS. 2-8), ring magnet 136 is positioned at a location for magnetic operative engagement with counter 200, i.e., ring magnet 136 magnetically draws or repels a complementary magnet or magnetically responsive material (not shown) in a first direction. When working element "W" of machine "M" is in a second or working condition (not shown), ring magnet 136 is positioned at a location to have no magnetic operative engagement with counter 200, i.e., ring magnet 136 does not magnetically draw or repel a complementary magnet or magnetically responsive material (not shown) in the first direction.

Figure 9:
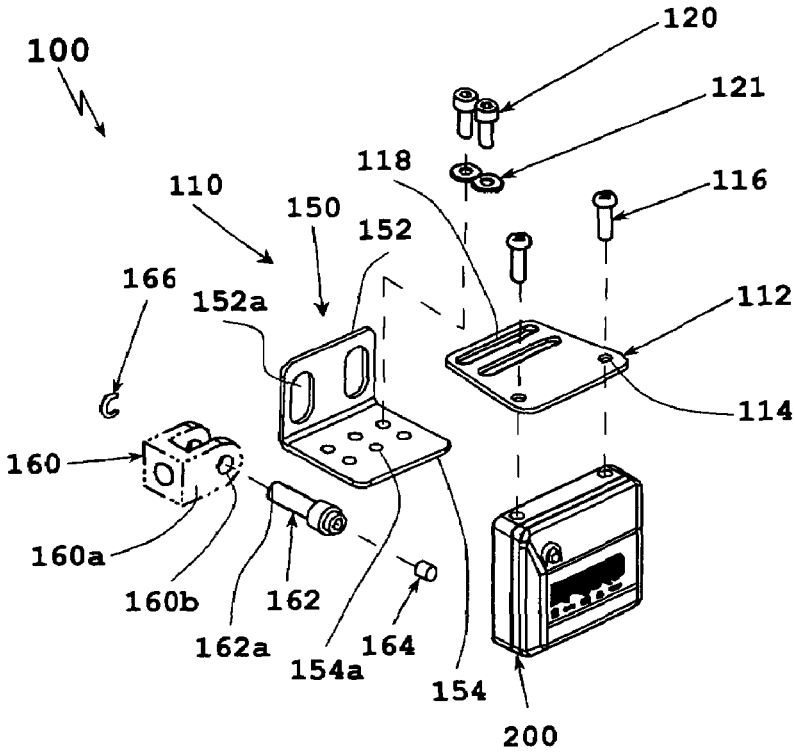
FIG. 9 is a perspective view, with parts separated, of an applicator counter assembly according to another embodiment of the present disclosure.
Figure 10:
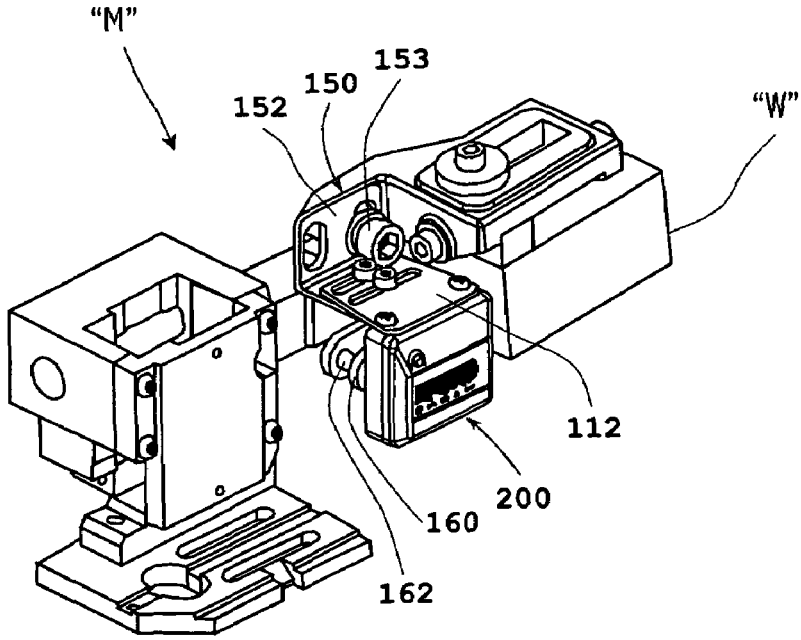
FIG. 10 is a perspective view of the applicator counter assembly of FIG. 9 shown operatively connected to an end air feed applicator.
Figure 11:
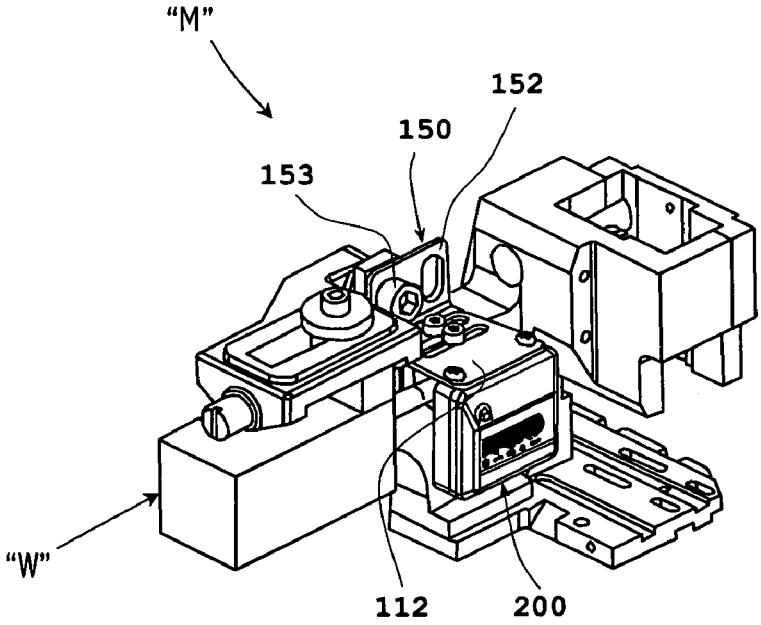
FIG. 11 is a perspective view of the applicator counter assembly of FIG. 9 shown operatively connected to a side air feed applicator.

Turning now to FIGS. 9-11, counter mounting kit 110 is configured and adapted for connecting counter 200 to a machine "M" having an end air feed, as seen in FIG. 10, or a machine "M" having a side air feed, as seen in FIG. 11. Counter mounting kit 110 includes an L-shaped bracket 150 having a back wall portion 152 and a bottom wall portion 154. Back wall portion 152 of L-shaped bracket 150 includes at least one aperture 152*a* formed therein for receiving a mounting element 153, e.g., a screw (see FIGS. 10 and 11). Bottom wall portion 154 of L-shaped bracket 150 includes a plurality of holes 154*a* formed therein. Holes 154*a* are formed at locations which align with elongate slots 118 formed in bracket 112. Holes 154*a* are configured and sized to receive screws 120. In use, bracket 112 is disposed on top of bottom wall portion 154 of L-shaped bracket 150.

Counter mounting kit 110 further includes a clevis 160 which is securable to machine "M" and which is configured and adapted to support a pin or rod 162. Pin or rod 162 includes a magnet 164 disposed at an end thereof. Desirably, pin or rod 162 extends through holes 160*b* formed in arms 160*a* of clevis 160. A retaining ring 166 may be provided and used to engage an annular groove 162*a* formed in pin or rod 162 and preventing pin or rod 162 from sliding out of holes 160*b* of clevis 160.

Desirably, when counter mounting kit 110 is used to mount counter 200 to a machine "M" having an end air feed, as seen in FIG. 10, or a machine "M" having a side air feed, as seen in FIG. 11, mounting kit 110 is configured to position magnet 164 proximate a predetermined location of counter 200 when machine "M" is in the idle condition. In use, when working element "W" of machine "M" is in the idle of first condition, magnet 164 is positioned at a location for magnetic operative engagement with counter 200 (i.e., magnet 164 magnetically draws or repels a complementary magnet or magnetically responsive material in a first direction. When working element "W" of machine "M" is in a second or working condition (not shown), magnet 164 is positioned at a location to have no magnetic operative engagement with counter 200, i.e., magnet 164 does not magnetically draw or repel a complementary magnet or magnetically responsive material in the first direction.

Figure 12:
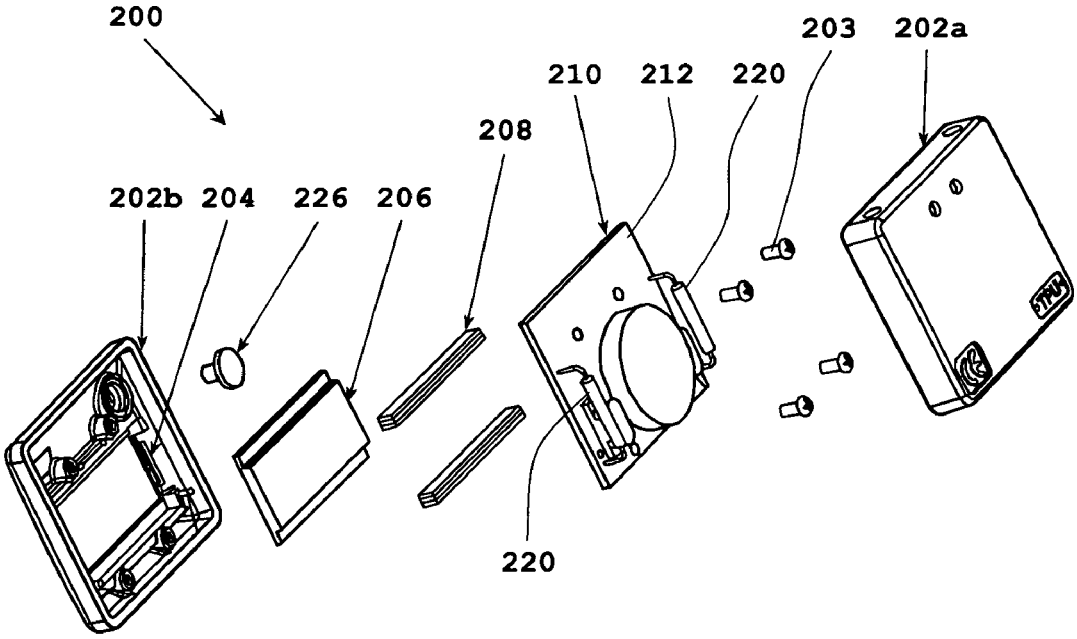
FIG. 12 is an exploded, perspective view of the counter of the assembly of FIG. 1.
Figure 13:
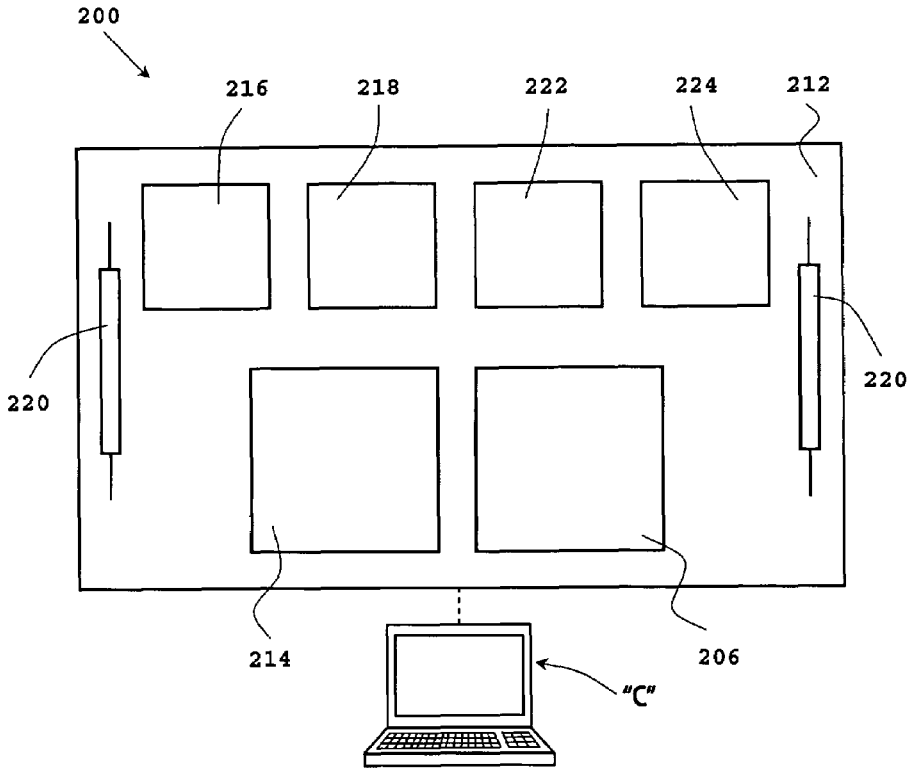
FIG. 13 is a schematic illustration of the counter of FIG. 12.

Turning now to FIGS. 12 and 13, a detailed discussion of counter 200 is provided. Counter 200 includes a housing 202 having a rear-half portion 202*a* and a front-half portion 202*b*. Rear-half portion 202*a* and front-half portion 202*b* are joined together using any method or technique known by one having skill in the art, such as, for example, spot welding, adhering, fastening and the like. Front-half portion 202*b* of housing 202 defines a window 204 formed therein for exposing a display 206 disposed within housing 202. Desirably, display 206 is an LCD (liquid crystal display) or any other graphic producing display available in the art.

At least one connector 208 is provided for electrically connecting display 206 to a circuit board assembly 210. Preferably, a pair of connectors 208 is used to electrically connect display 206 to circuit board assembly 210. It is envisioned that connectors 208 are "zebra-type" connectors.

Counter 200 includes a circuit board assembly 210 mounted within housing 202 having half-sections 202*a*, 202*b* using mounting elements 203 (e.g., screws or the like). Circuit board assembly 210 includes a printed circuit board 212 supporting at least a microchip 214, a battery 216 or other energy source, a display controller 218, at least one reed or Hall effect switch 220 or any other magnetically responsive switch, an IrDA® controller 222 or any other data transmitting controller, and a storage element 224.

Figure 14:
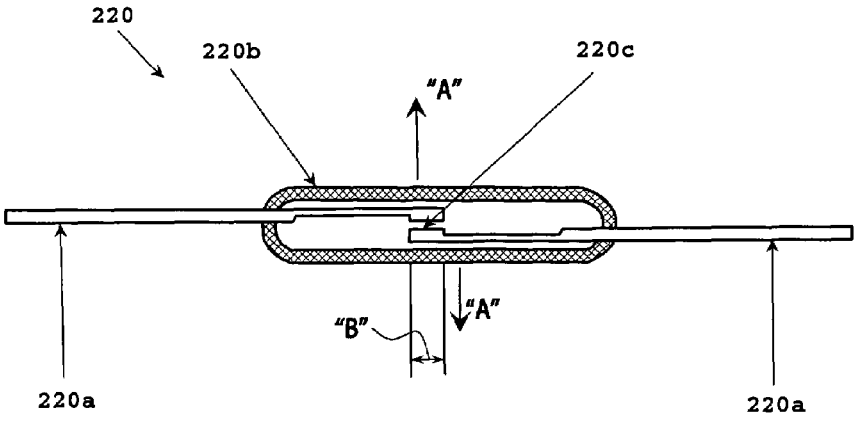
FIG. 14 is a schematic illustration of a reed switch.

Reed switches 220 are configured and adapted to activate and/or function upon exposure to magnetic forces and the like. For example, as seen in FIG. 14, reed switch 220 includes two identical flattened ferromagnetic reeds 220*a*, sealed in a dry inert-gas atmosphere within a capsule 220*b*, thereby protecting reeds 220*a* from contamination. Reeds 220*a* are sealed in capsule 220*b* in cantilever form so that their free ends overlap (as indicated by arrow "B") and are separated by a small gap 220*c*. In operation, when a magnetic force is generated parallel to reed switch 220, reeds 220*a* become flux carriers in the magnetic circuit. The overlapping ends of reeds 220*a* become opposite magnetic poles, which attract each other. If the magnetic force between the poles is strong enough to overcome the restoring force of reeds 220*a* (as indicated by arrows "A"), reeds 220*a* will be drawn together and complete an electrical circuit. In the case of counter 200, each contacting of reeds 220*a* with one another represents a single count of operation of machine "M".

It is envisioned that microchip 214 and storage element 224 may retain the following data fields: total count; permanent data; and tooling data. The permanent data may include information about the machine and/or tool "M", such as, for example, the date manufactured; the serial number; the part number; and the customer data. The tooling data may include information such as the part number, date, and cycle count for wire crimpers, insulation crimpers, anvils, sheer tools, maintenance data and the like.

IrDA® controller 222 uses an IrDA® built into circuit board assembly. IrDA® controller 222 enables creation of a wireless interface to a separate computer for data transfer.

To conserve power, display 206 and IrDA® controller 222 are desirably normally in an "off " condition. To activate display 206 and IrDA® controller 222, a push-button 226, supported in front-half portion 202*b* of housing 202 is depressed.

In use, as magnet 136 or 164 is approximated toward reed switch 220, the magnetic force generated by magnate 136 or 164 is strong enough to overcome the restoring force of reeds 220*a* and will draw reeds 220*a* together to complete an electrical circuit and register a single count of operation for machine "M". In one embodiment, all of the counts registered are stored in storage element 224 of counter 200 and, if desired, processed and/or manipulated by microchip 214. The processes information is later transmitted, via IrDA® controller 222 to an external, remote computer "C" (see FIG. 13). Alternatively, in another embodiment, all of the counts are transmitted immediately to computer "C" for storage and/or further processing and manipulating.

By using applicator counter assembly 100 to monitor, store and process data regarding the usage of machine and/or tool "M" (e.g., the count or number of times the machine and/or tool is used), the user is better able to predict and/or forecast when machine and/or tool maintenance or replacement will be necessary. In this manner, all the necessary replacement machines and/or tools may be acquired ahead of time, or all of the necessary repair equipment may be readied ahead of time in order to reduce the time machine and/or tool "M" is kept idle, i.e., downtime.

It is to be understood that the foregoing description is merely a disclosure of particular embodiments and is no way intended to limit the scope of the invention. Other possible modifications will be apparent to those skilled in the art and all modifications will be apparent to those in the art and all modifications are to be defined by the following claims.

What is claimed is:

1. An applicator counter for operation with an applicator, said applicator counter comprising:

a housing; and a circuit board assembly operatively disposed within the housing, the circuit board assembly including:

a printed circuit board;

a microchip supported on the printed circuit board for processing and manipulating information;

an energy source supported on the printed circuit board for powering at least the microchip;

a magnetically responsive switch supported on the printed circuit board, the switch being actuated in response to a magnetic force, whereby the circuit board assembly registers a count for each actuation of the switch; and a storage element supported on the printed circuit board for storing information, the storage element configured to store a total count of each actuation of the switch and a cycle count for a tool associated with the applicator.

2. The applicator counter according to claim 1, wherein the magnetically responsive switch is a reed switch.

3. The applicator counter according to claim 2, wherein the circuit board assembly includes at least a pair of reed switches positioned at opposing sides thereof.

4. The applicator counter according to claim 1, wherein the circuit board assembly further comprises a data transmitting controller supported on the printed circuit board for transmitting information to a remote location.

5. The applicator counter according to claim 1, wherein the cycle count for the tool associated with the applicator is less than the total count.

6. The applicator counter according to claim 1, wherein the storage element is configured to store at least one of permanent data and tooling data.

7. The applicator counter according to claim 4, wherein the data transmitting controller is a wireless controller.

8. The applicator counter according to claim 1, wherein the storage element is configured to store a plurality of cycle counts that each correspond to a different tool associated with the applicator, wherein a first of the plurality of cycle counts is less than the total count and a second of the plurality of cycle counts is equal to the total count.

9. An applicator counter assembly for operative association with an applicator, the applicator counter assembly comprising:

an applicator counter for counting, recording and transmitting cycles of the applicator, the applicator counter including a magnetically responsive switch configured to actuate in response to a magnetic force, whereby the applicator counter registers a count for each actuation of the switch; and a counter mounting kit for mounting the applicator counter to the applicator, the counter mounting kit including:

a bracket configured to interconnect the applicator counter and the applicator;

a magnet operatively supportable on a working element of the applicator; the magnet having a first position, corresponding to when the working element is in an idle condition, in which the magnet does not cause the magnetically responsive switch to actuate, and a second position, corresponding to when the working element is in an active condition, in which the magnet causes the magnetically responsive switch to actuate, wherein the applicator counter registers each count;

a guide selectively mountable to the bracket; and a rod extending through the guide and configured to support the magnet thereon.

10. The applicator counter assembly according to claim 9, wherein the applicator counter includes:

a housing defining at least one window;

a display operatively disposed within the housing and visible through the window formed in the housing; and a circuit board assembly operatively disposed within the housing and in electrical contact with the display, the circuit board assembly including:

a printed circuit board;

a microchip supported on the printed circuit board for processing and manipulating information;

an energy source supported on the printed circuit board for powering at least the display and the microchip; and a storage element supported on the printed circuit board for storing information.

11. The applicator counter assembly according to claim 10, wherein the magnetically responsive switch is a reed switch.

12. The applicator counter assembly according to claim 11, wherein at least a pair of reed switches are provided and are each supported at opposite ends of the printed circuit board.

13. The applicator counter assembly according to claim 10, wherein the circuit board assembly further comprises a data transmitting controller supported on the printed circuit board for transmitting information to a remote location.

14. The applicator counter assembly according to claim 13, wherein the data transmitting controller is a wireless controller.

15. The applicator counter assembly according to claim 9, wherein the rod is selectively connectable to the working element of the machine, wherein movement of the working element results in movement of the rod.

16. The applicator counter assembly according to claim 9, wherein the bracket is configured to enable adjustment of the location of the applicator counter.

17. The applicator counter assembly according to claim 9, wherein the guide is a clevis and the rod extends through arms of the clevis.

18. The applicator counter assembly according to claim 9, wherein when the working element of the machine is in an active condition, the magnet is positioned at a magnetically effective distance relative to the magnetically responsive switch.

19. An applicator counter for operation with an applicator, said applicator counter comprising:

a housing; and a circuit board assembly operatively disposed within the housing, the circuit board assembly including:

a printed circuit board;

a microchip operatively connected to the printed circuit board for processing and manipulating information;

an energy source operatively connected to the printed circuit board for powering at least the microchip;

a storage element operatively connected to the printed circuit board for storing information, the storage element configured to store information about each of a plurality of different tools associated with the applicator; and a switch operatively connected to the printed circuit board, the switch being actuated in response to a force, whereby the circuit board assembly registers a count for each actuation of the switch.

20. The applicator counter according to claim 19, wherein the information about each of the plurality of tools comprises at least one of a part number associated with at least one of the plurality of tools, a date associated with at least one of the plurality of tools, a cycle count for at least one of the plurality of tools, and maintenance data associated with at least one of the plurality of tools.

21. An applicator counter for operation with an applicator, said applicator counter comprising:

a housing; and a circuit board assembly operatively disposed within the housing, the circuit board assembly including:

a printed circuit board;

a microchip supported on the printed circuit board for processing and manipulating information;

an energy source supported on the printed circuit board for powering at least the microchip;

a storage element supported on the printed circuit board for storing information, the storage element configured to store a total count of each actuation of the switch and a cycle count for a tool associated with the applicator; and a pair of magnetically responsive switches positioned on opposing sides of the circuit board assembly, the switches being actuated in response to a magnetic force.

* * * * *